US005533221A

United States Patent [19]

Majnaric et al.

[11] Patent Number: 5,533,221

[45] Date of Patent: Jul. 9, 1996

[54] METHOD AND APPARATUS FOR BRIDGE CONSTRUCTION

[75] Inventors: Anton B. Majnaric, Copley; William M. Bjerke, Hudson, both of Ohio

[73] Assignee: Majnaric Technologies, Inc., Copley, Ohio

[21] Appl. No.: 383,882

[22] Filed: Feb. 6, 1995

[51] Int. Cl.[6] ..... E01D 21/00; E04B 1/16

[52] U.S. Cl. ..... 14/73; 14/77.1; 404/70; 52/742.14; 52/448

[58] Field of Search ..... 14/73, 77.1, 2.4, 14/18, 19, 20, 23; 404/70, 134, 44–45, 40; 52/664, 667, 668, 669, 742.14, 745.2, 448

[56] References Cited

U.S. PATENT DOCUMENTS

| | | | |
|---|---|---|---|
| 1,666,157 | 4/1928 | Voskamp | 14/73 |
| 1,936,536 | 11/1933 | Bates | 14/73 |
| 2,114,773 | 4/1938 | Auten et al. | 14/73 |
| 3,956,864 | 5/1976 | Fung | 52/448 X |
| 3,959,940 | 6/1976 | Ramberg | 52/448 X |
| 4,227,829 | 10/1980 | Landry, Jr. | 404/40 X |
| 4,457,035 | 7/1984 | Habegger et al. | 14/18 |
| 4,865,486 | 9/1989 | Bettigule | 404/44 X |
| 5,121,518 | 6/1992 | Muller | 14/18 X |
| 5,463,786 | 11/1995 | Mangone et al. | 404/70 X |

FOREIGN PATENT DOCUMENTS

| | | | |
|---|---|---|---|
| 1030462 | 7/1983 | U.S.S.R. | 14/18 |
| 1030463 | 10/1983 | U.S.S.R. | 14/18 |

*Primary Examiner*—David J. Bagnell
*Assistant Examiner*—James A. Lisehora
*Attorney, Agent, or Firm*—Renner, Kenner, Greive, Bobak, Taylor & Weber

[57] ABSTRACT

A method and apparatus for building bridges from one location to another, and in which the construction activity takes place primarily at such terminal locations. Forms are assembled at one of the locations, such forms establishing the characteristics of the bridge deck to be built. When the forms are completed, they are elevated and suspended upon cables passing between the two locations. The forms are then pulled from one location toward the other, sequentially engaging with previously built and positioned forms until an entire complement of such forms extends between the two locations. The forms are then filled with concrete and finished. The forms provide an exterior finished surface for the bridge structure.

15 Claims, 4 Drawing Sheets

METHOD AND APPARATUS FOR BRIDGE CONSTRUCTION

TECHNICAL FIELD

The invention herein resides in the art of techniques and apparatus for construction of bridges. More particularly, the invention relates to such a technique and apparatus allowing for the construction of a bridge without the need for lifts, scaffolding, or the like. Specifically, the invention relates to such an apparatus and technique whereby a bridge may be constructed by employing forms assembled at one location and transported across supporting cables to an opposite location until the forms extend between the two locations, which forms are subsequently filled with concrete or the like.

BACKGROUND ART

The use of a bridge to span a low lying area such as a valley, river, or the like, or to serve as an overpass for a highway, is presently well known. Typically, bridge construction requires the use of lifts, scaffolding, or the like to erect the bridge from the ground up, necessarily aggravating the cost and time employed. Additionally, such prior techniques typically involve the interruption of activities below the bridge during construction.

There is a need in the art for an apparatus and technique by which a bridge may be caused to span between two locations, and wherein the activity of bridge construction is primarily undertaken at those locations, and not in the space between them. There is additionally a need in the art for an apparatus and method for bridge construction which allows for the use of pre-made forms of a standard interlocking nature which may be quickly joined together and suspended from cables between two distant locations to provide a completed form to receive concrete and the like.

DISCLOSURE OF INVENTION

In light of the foregoing, it is a first aspect of the invention to provide a method and apparatus for bridge construction for forming concrete structures which may serve as the under structure and support of highway bridge decks.

Another aspect of the invention is the provision of a method and apparatus for bridge construction in which light weight permanent forms and light weight tension cables are employed as the basic construction components.

Yet a further aspect of the invention is the provision of a method and apparatus for bridge construction which avoid the usual necessity of scaffolding to support removable forms and a base upon which they may be erected.

Yet another aspect of the invention is to provide a method and apparatus for bridge construction which allows for erection of a bridge without interrupting the flow of traffic or nature below the structure, and which promotes a minimal amount of ecological interruption.

An additional aspect of the invention is to provide a method and apparatus for bridge construction which is simplistic to employ and which attains a bridge structure of remarkable integrity.

The foregoing and other aspects of the invention which will become apparent as the detailed description proceeds are achieved by an apparatus for bridge construction, comprising: a bottom form having first locking means at opposite lateral edges thereof for engaging a laterally adjacent bottom form, and having second locking means at longitudinal edges thereof for engaging a longitudinally adjacent bottom form; a support rod laterally traversing and engaging said bottom form; and a plurality of cables extending longitudinally of said bottom form, engaging said support rod and suspending said bottom form.

Other aspects of the invention which will become apparent herein are attained by a method of constructing a bridge, comprising: stringing a plurality of cables between first and second locations; suspending a first bottom form from said cables at said first location; transporting said first bottom form across said cables from said first location toward said second location; suspending a second bottom form from said cables at said first location; and transporting said second bottom form across said cables from said first location towards said second location and into interengagement with said first said bottom form.

DESCRIPTION OF DRAWINGS

For a complete understanding of the objects, techniques, and structure of the invention reference should be made to the following detailed description and accompanying drawings wherein.

BEST MODE FOR CARRYING OUT THE INVENTION

Figure 1:
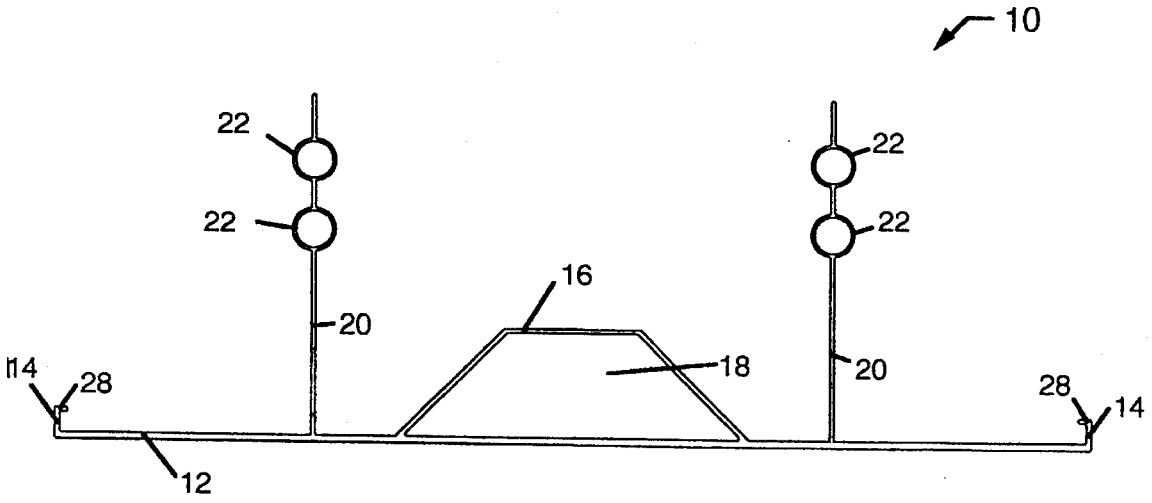
FIG. 1 is an end view of a standard bottom form according to the invention and including optional cored tubing therein.
Figure 2:
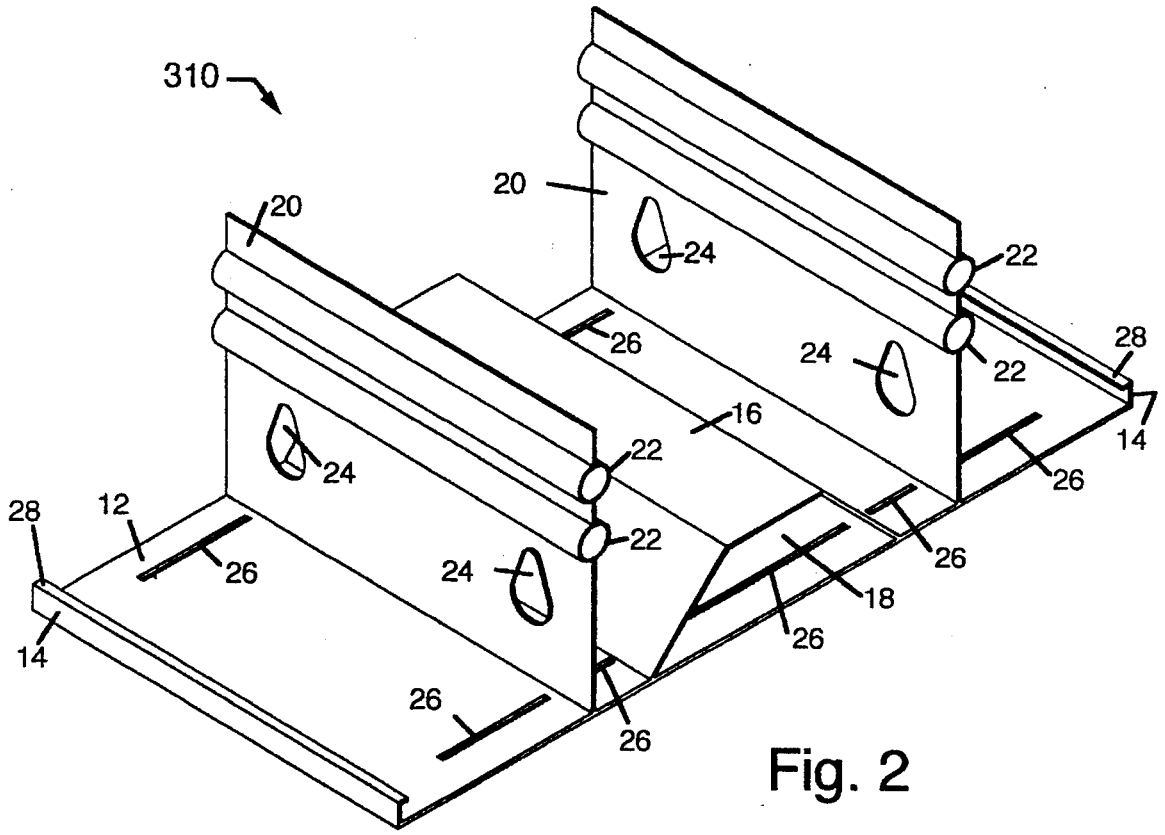
FIG. 2 is an isometric view of a standard bottom form according to the invention and as shown in FIG. 1.

In order to fully appreciate the structure and technique of the invention, it is preferable to first gain an understanding of the component parts employed in manufacturing a bridge deck form segment. Referring first to FIGS. 1 and 2, it can be seen that a bottom form employed in accordance with the invention is designated generally by the numeral 10. It will be appreciated that the bottom form 10 and the other forms referenced herein are preferably manufactured of an appropriate synthetic material such as polyvinylchloride (PVC). The bottom form 10 includes a planar base 12 having channel members 14 established and defined along lateral side edges thereof. As illustrated, each of the channel members 14 has an inwardly extending top ledge 28. A truncated pyramidal cover 16 rises up and extends over a central portion of the planar base 12, defining an elongated trapezoidal cavity 18 therewith.

A pair of walls 20 extends upwardly from the base 12 and are typically perpendicular thereto. The walls 20 are positioned on either side of the cover 16, as shown. According to one embodiment of the invention, tubular conduits 22 are received by and extend longitudinally along the walls, there being two such conduits 22 in each of the walls in the embodiment shown. As illustrated, the conduits 22 are preferably positioned in the upper half of the walls 20. Also provided in each of the walls 20 are a pair of teardrop slots 24 positioned near the longitudinal ends of the wall 20. The larger radiused end of the slots 24 is downward, while the smaller radiused end is upward in true teardrop configuration.

It will also be noted that the base 12 is characterized by a plurality of slots 26 along opposite lateral edges thereof. The slots 26 are uniformly spaced from the associated edge, as illustrated. In the preferred embodiment of the invention, the slots 26 pass completely through the base 12. It will also be appreciated that the bottom form 10 may be of any of various sizes. While the particular embodiment shown in the drawing demonstrates the lateral dimension to be greater than the longitudinal one, such need not be the case. Indeed, the forms 10 may be configured in any of various sizes to fit particular needs.

Figure 3:
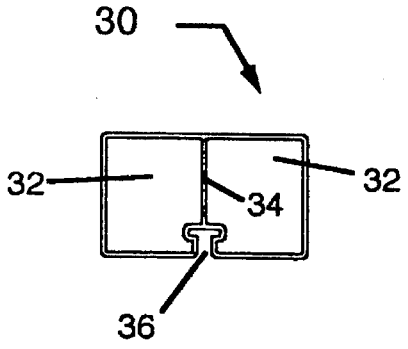
FIG. 3 is an end view of a standard form joiner used in accordance with the invention and shown in rectangular configuration.
Figure 4:
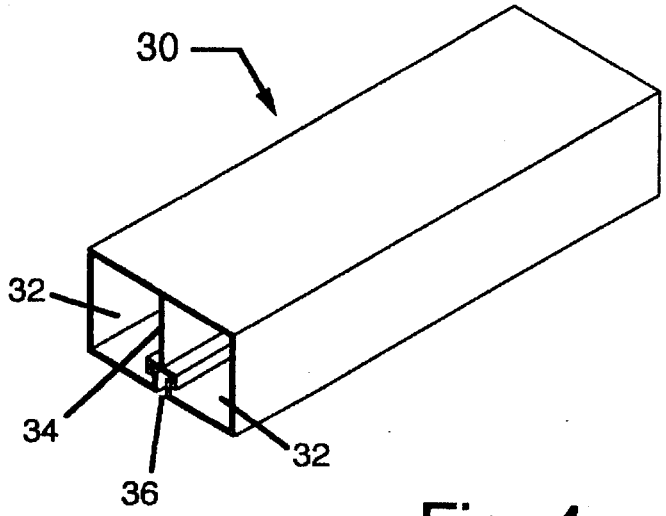
FIG. 4 is an isometric view of the form joiner of FIG. 3.

Referring now to FIGS. 3 and 4, it can be seen that a form joiner member according to the invention is designated by the numeral 30. Again, this member is preferably of PVC or other suitable material. The joiner member 30 includes a pair of square channels 32 sharing a common center wall 34. Of course, the specific geometric configuration of the channel member may be varied. A "T" channel is configured at a bottom of the common wall 34 and is opened at the base of the juncture of the square cavities 32, as shown. The "T" channel 36 is configured and adapted to receive abutted channel members 14 with the top ledges 28 forming the top of the "T". It will be readily appreciated that the form joiner members 30 may be employed to fixedly secure laterally adjacent bottom forms 10, with the channel 36 matingly receiving abutted pairs of channel members 14.

Figure 5:
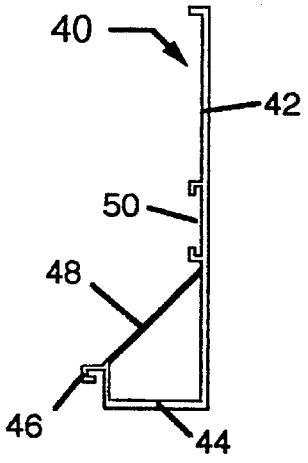
FIG. 5 is an end view of an edge form employed by the invention.
Figure 6:
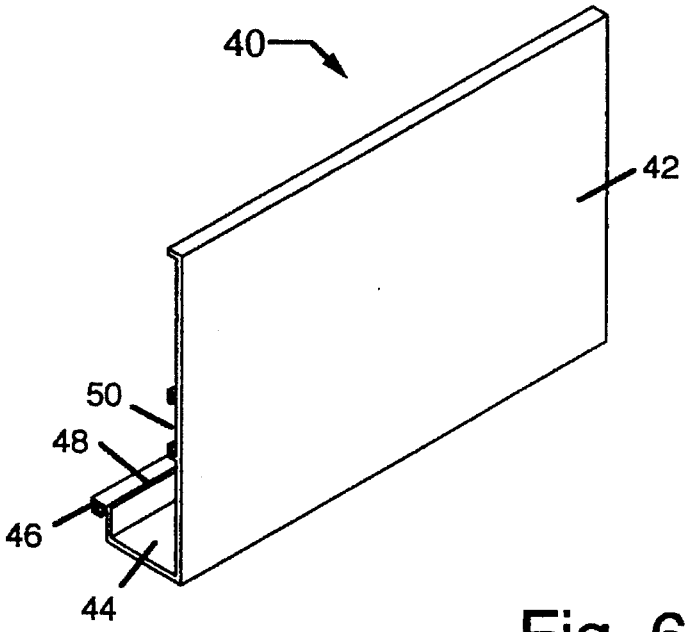
FIG. 6 is an isometric view of the standard edge form of the invention as shown in FIG. 5.

With reference now to FIGS. 5 and 6, it can be seen that an edge form in accordance with the invention is designated by the numeral 40 and comprises an orthogonally connected wall 42 and base 44. A channel 46 is defined at an outer edge of the base 44 opposite the wall 42 and is provided with the same height as the channel 14 and being configured such as to matingly engage a channel 14. A slanted wall 48 extends upwardly from a top corner edge of the channel 46 to the wall 42 and forming a cavity therewith, as shown. Also extending longitudinally along the wall 42 above the slanted wall 48 is a channel 50 adapted for receiving a support rod cap in a manner to be discussed below.

Figure 7:
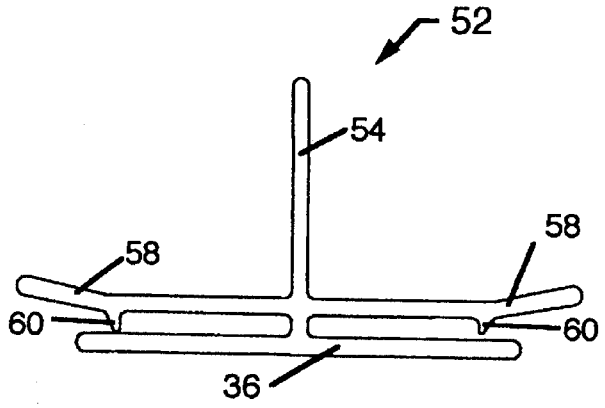
FIG. 7 is an end view of a standard section joiner used in accordance with the invention.
Figure 8:
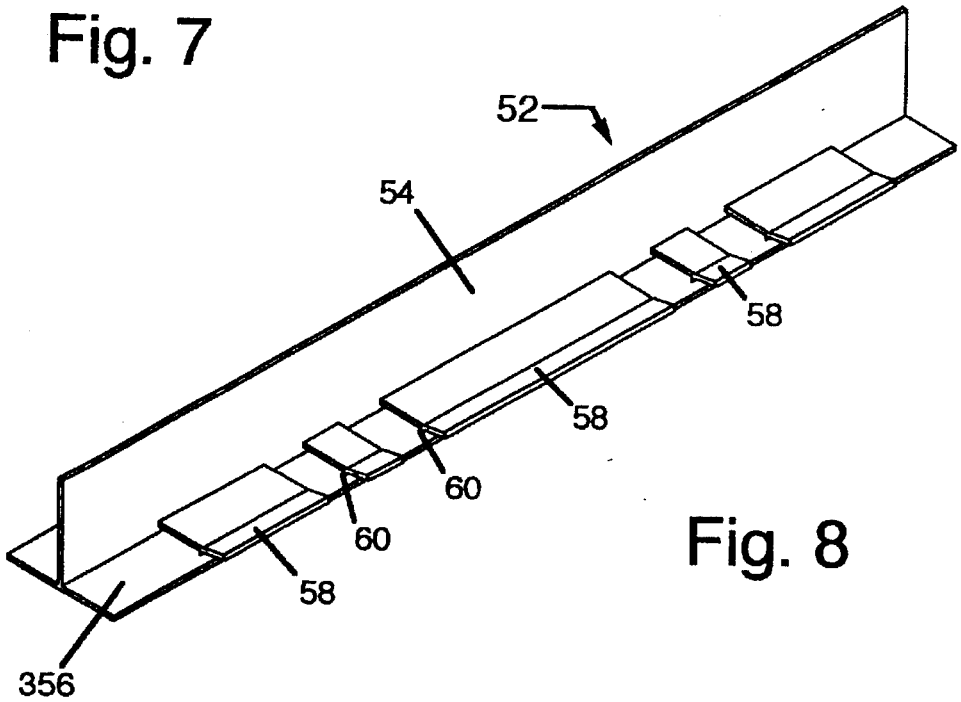
FIG. 8 is a isometric view of the standard section joiner shown in FIG. 7.

With reference now to FIGS. 7 and 8, it can be seen that a section joiner according to the invention is designated by the numeral 52. Here, a center wall 54 extends upwardly and orthogonally from the center of a base member 56. A plurality of deflectable tabs 58 extend from opposite sides of the center wall 54 and are positioned above the base 56 as shown. In the preferred embodiment of the invention, the spacing between the tabs 58 and the base 56 are substantially equal to or slightly greater than the thickness of the base 12 of the bottom form 10. A plurality of protrusions or barbs 60 extend downwardly from the deflectable tabs 58 and toward the base 56. The spacing of the barbs 60 from the vertical wall 54 is substantially equal to or slightly less than the spacing of the slots 26 from their respective edges of the base 12 in the bottom form 10.

Figure 9:
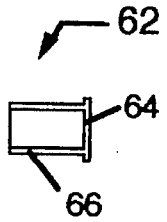
FIG. 9 is a cross sectional view of a lateral bar positioning cap employed in accordance with the invention.
Figure 10:
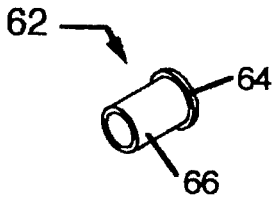
FIG. 10 is an isometric view of the lateral bar positioning cap of FIG. 9.

Referring now to FIGS. 9 and 10, it can be seen that a cap 62 according to the invention comprises a head 64 having a tubular body member 66 extending therefrom. The diameter of the head 64 is substantially equal to, but slightly less than the opening between the flanges of the channel 50 to be received and securedly engaged therein.

Figure 11:
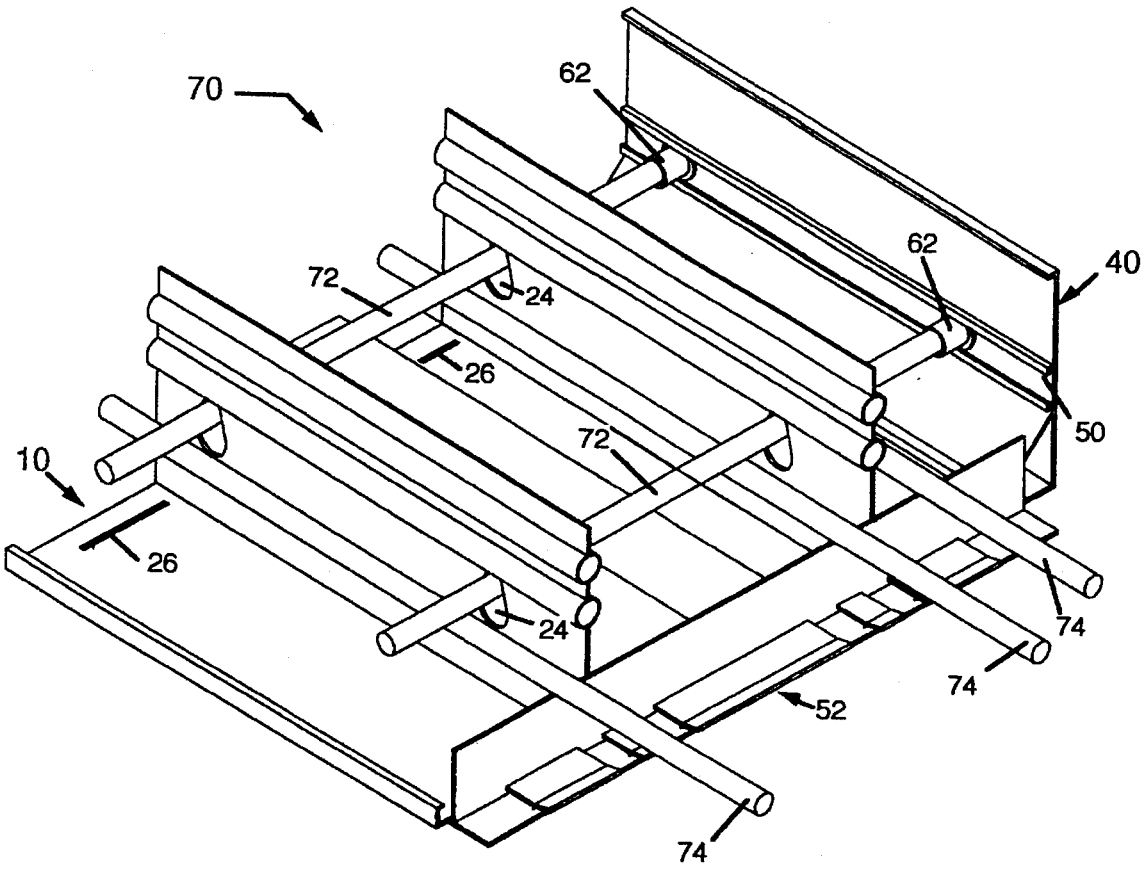
FIG. 11 is an isometric view of the forms and joiners as set forth in FIGS. 1–10 to establish a bridge deck form segment in accordance with the invention.

With reference now to FIG. 11, the implementation of the various elements just described in devising a bridge deck form segment 70 can be seen. As shown, a bottom form 10 has an edge form 40 connected along one side thereof as by means of interengagement of channel members 46, 14. Similarly, a trailing edge of the base 12 of the bottom form 10 is matingly connected with a section joiner 52 as by interengagment of the barbs 60 with aligned slots 26. Typically, the channel member 14 on the side of the form 10 opposite that receiving the edge form 40 would receive either an edge form 40 or be matingly engaged to another channel member 14 of another bottom form 10 as by means of a form joiner member 30. With that configuration of forms so made, they are positioned beneath a plurality of permanent support cables 74 which extend between first and second locations which define the terminal points of the bridge to be constructed. Caps 62 are slid into the channel 50 and the bridge deck form segment 70 is then lifted such that the teardrop holes 24 are above the permanent cables 74. At this time, a support rod 72 such as rebar or the like is slid through the openings 24 and into receiving engagement with the cap 62. Of course, a plurality of such bars are typically so positioned.

The segment 70 is then lowered upon the permanent cables 74 and supported thereon by means of the support bars 72. The segment 70 is then pulled from the first location to the second location and a subsequent identical segment 70 is then constructed at the first location and the process is repeated, with the second such form segment 70 engaging the previous segment 70 as by interlocking engagement of the section joiner 52 of the first such segment with the slots 26 of the second. This process repeats until the entire span between the first and second locations is populated with interconnected segments 70 maintained upon the permanent cables 74. Those skilled in the art will readily appreciate that a large plurality of such cables 74 will typically be employed for purpose of suspending the bridge deck assembly.

With all of the forms segments in place, the forms may begin to be filled with concrete to the level of the top edge of the vertical wall 42 of the edge forms 40 on either lateral side of the bridge assembly. Sections of the bridge may be poured and cured independently of each other, or the entire bridge structure may be poured simultaneously. It will be appreciated that the trapezoidal cavity 18 remains devoid of concrete, as do the cavities at the sidewall defined by the sloping wall 48 interconnecting the channel 46 and the vertical wall 42. These cavities are blocked and sealed by the center wall 54 of the section joiner 52, as best shown in FIG. 11. Additionally, the suspension cable 74 and the support rods 72 serve as rebar in the deck assembly. It will further be noted that the forms 10, 40 may be left in place after the curing operation and may form a finished outer surface of the bridge structure since the same are preferably made of PVC or other environmentally stable synthetic material.

The conduits 22 remain open and are contemplated for the passage of heated fluid or the like to prevent water from freezing upon the bridge at low ambient temperatures. Of course, the conduits 22 are optional for that purpose and may be eliminated if that feature is not desired.

It is presently contemplated that intermediate support structures may be employed in accordance with the invention for bridges of substantial span. The method of construction would, however, remain substantially the same.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. Apparatus for bridge construction, comprising:

a bottom form having first locking means at opposite lateral edges thereof for engaging a laterally adjacent bottom form, and having second locking means at longitudinal edges thereof for engaging a longitudinally adjacent bottom form;

a support rod laterally traversing and engaging said bottom form; and a plurality of cables extending longitudinally of said bottom form, engaging said support rod and suspending said bottom form.

2. The apparatus according to claim 1, wherein said bottom form comprises a base having walls extending upwardly therefrom, said walls having apertures for receiving said support rod.

3. The apparatus according to claim 2, wherein said walls extend longitudinally of said base and said support rod extends between said walls.

4. The apparatus according to claim 3, further comprising conduits received by said walls and extending longitudinally therewith.

5. The apparatus according to claim 1, wherein said first locking means comprises first channel members extending along said lateral edges.

6. The apparatus according to claim 5, further comprising second channel members adapted for matingly engaging a pair of abutting first channel members of laterally adjacent bottom forms.

7. The apparatus according to claim 1, wherein said bottom form has a base and wherein said second locking means comprise a plurality of slots passing through said base of said bottom form, and further comprising section joiners adapted for engaging said slots of longitudinally adjacent bottom forms.

8. The apparatus according to claim 7, wherein each said section joiner comprises a center wall extending from a base, and deflectable tabs extending from said wall and adapted to engage said slots.

9. The apparatus according to claim 8, wherein said tabs are spaced apart from and parallel to said base, said tabs having barbs for engaging said slots.

10. The apparatus according to claim 1, further comprising a wall adapted for mating engagement with said first locking means, said wall having means for engaging said support rod.

11. The apparatus according to claim 10, wherein said means for engaging said support rod comprises a channel longitudinally traversing said wall and a cap received within said channel, said cap engaging said support rod.

12. The apparatus according to claim 10, wherein said bottom form has a base having a void area longitudinally traversing said base, and wherein said wall has a void traversing a lower corner portion thereof.

13. The method of constructing a bridge, comprising:

stringing a plurality of cables between first and second locations;

positioning a plurality of support rods within a first bottom form;

suspending said first bottom form from said cables at said first location, wherein said cables support said support rods within said first bottom form;

transporting said first bottom form across said cables from said first location toward said second location;

positioning a plurality of support rods within a second bottom form;

suspending said second bottom form from said cables at said first location; and transporting said second bottom form across said cables from said first location toward said second location and into interengagement with said first bottom form.

14. The method according to claim 13, further comprising the steps of suspending and passing subsequent bottom forms across said cables until interconnected bottom forms extend from said second location to said first location.

15. The method according to claim 14, further comprising the step of filling said interconnected bottom forms with concrete.

* * * * *